US005207191A

United States Patent [19]

Pryba et al.

[11] Patent Number: 5,207,191

[45] Date of Patent: May 4, 1993

[54] BOAT-TYPE ROCKER ARM WITH STIFFENING MEMBER

[75] Inventors: Stanley J. Pryba, Toledo; Terry R. Shook, Sylvania; Arshad I. Suri, Maumee, all of Ohio

[73] Assignee: Henley Manufacturing Holding Company, Inc., Hampton, N.H.

[21] Appl. No.: 937,562

[22] Filed: Aug. 31, 1992

[51] Int. Cl.[5] ..... F01L 1/18

[52] U.S. Cl. ..... 123/90.39; 123/90.41; 74/519; 74/559

[58] Field of Search ..... 123/90.39, 90.4, 90.41, 123/90.42, 90.44, 90.47; 74/519, 559

[56] References Cited

U.S. PATENT DOCUMENTS

| | | | |
|---|---|---|---|
| 2,905,161 | 9/1959 | Latham | 123/90.39 |
| 4,825,717 | 5/1989 | Mills | 123/90.39 |
| 4,848,180 | 7/1989 | Mills | 123/90.39 |
| 4,858,575 | 8/1989 | Fittro et al. | 123/90.41 |
| 4,940,048 | 7/1990 | Mills | 123/90.39 |
| 5,060,606 | 10/1991 | Hubbard | 123/90.39 |
| 5,074,261 | 12/1991 | Hamburg et al. | 123/90.39 |

FOREIGN PATENT DOCUMENTS 64836 11/1982 European Pat. Off. ..... 123/90.39

*Primary Examiner*—E. Rollins Cross
*Assistant Examiner*—Weilun Lo
*Attorney, Agent, or Firm*—Allen D. Gutchess, Jr.

[57] ABSTRACT

A one-piece, cold-formed rocker arm is of the boat-type. It includes a one-piece metal body which is cold formed from a metal blank and is of generally U-shaped cross-sectional configuration throughout most of its length. The rocker arm body has two generally parallel side walls and a connecting bottom wall therebetween. The body also has inwardly-extending side walls extending from the parallel ones toward both ends of the body. The bottom wall extends between the side walls and has an opening for receiving a pivotal support, a recess for receiving a push rod at one end, and a pad for engaging an end of a valve stem at the other end. An elongate stiffening member extends between upper edges of side walls and specifically between the inwardly-extending side walls extending toward the push rod end of the body. The stiffening member preferably is a rod received in notches in the upper ends of the edges of the side walls and affixed thereto by resistance welding.

17 Claims, 2 Drawing Sheets

BOAT-TYPE ROCKER ARM WITH STIFFENING MEMBER

This invention relates to a boat-type rocker arm with an elongate stiffening member.

The rocker arm is cold-formed and specifically stamped. Such rocker arms have several advantages over cast rocker arms. Stamped rocker arms are usually less expensive to manufacture, especially when produced in larger quantities so that die costs can be spread out more. In particular, stamped rocker arms are lighter in weight, an important advantage because lighter engines and vehicles result in better fuel economy and engine efficiency or, alternatively, in higher performance for the engines. In general, however, cast rocker arms tend to be more stiff than stamped ones.

A boat-type rocker arm is centrally pivotally supported and is engaged by a push rod at one end and, in turn, engages a valve stem at the other end during operation. Deflection in the rocker arm between its end portions during operation is seemingly minuscule. However, even a minute deflection has an effect on engine operation. Consequently, stiffness in a rocker arm is of substantial importance and absolute minimal deflection, if any, is desired for ultimate engine operation and efficiency.

The rocker arm according to the invention is of the boat-type and is made by cold-forming operations, including stamping, coining, staking, and back-packing. The rocker arm includes a one-piece metal body which is of U-shaped cross-sectional configuration throughout substantially most of its length. The body includes a bottom wall with structurally-integral side walls extending upwardly therefrom. A first end portion of the rocker arm body has a recess formed therein to receive an upper end of a push rod. A second end portion of the rocker arm has additional means in the form of a pad to receive an end of a valve stem. An intermediate portion of the bottom wall of the body is generally concave, facing upwardly. A middle part of the concave portion has an opening through which a pivotal support or pedestal extends, the pedestal having a fulcrum which engages the concave portion of the bottom wall to provide pivotal support for the rocker arm.

Intermediate portions of the side walls of the rocker arm are substantially parallel but may flare outwardly slightly, away from one another. During operation of boat-type rocker arms, the side walls tend to buckle, with the bottom wall deflecting. This changes the relationship between the two end portions of the rocker arm and can have an adverse effect on the operation of the engine.

To increase stiffness, intermediate portions of the side walls of the rocker arm have been formed with flanges extending outwardly at upper portions thereof which substantially enhances the stiffness of the side walls and cause deflection to be decreased during operation (see U.S. Pat. No. 4,940,048, issued Jul. 10, 1990). However, with some engines, such flanges cannot be used because of space limitations.

In accordance with the invention, it has been found that a stiffening member can be located transversely to the rocker arm body and affixed to upper edges of side walls thereof to increase the stiffness substantially. Preferably, the stiffening member is positioned so that a vertical plane through it, when the rocker arm is in a horizontal position, extends between the push rod end of the rocker arm body and the opening which receives the supporting pedestal or pivotal support. The elongate stiffening member can be in the form of a rod with is affixed to the side wall edges by resistance welding. Preferably, the side wall edges have notches in which the stiffening member is received so that it does not extend upwardly above the profile of the rocker arm. Also, the ends of the stiffening member do not extend outwardly beyond the planes of the parallel side walls. Consequently, the stiffening member can be used with any rocker arm even though there are space limitations within which the rocker arm must operate.

It is, therefore, a principal object of the invention to provide a cold-formed, boat-type rocker arm which has a stiffening member extending between side walls thereof to cause less deflection when the rocker arm is in operation.

A further object of the invention is to provide a rocker arm of the boat-type having the advantages and features discussed above.

Many other objects and advantages of the invention will be apparent from the following detailed description of a preferred embodiment thereof, references being made to the accompanying drawings, in which.

Figure 1:
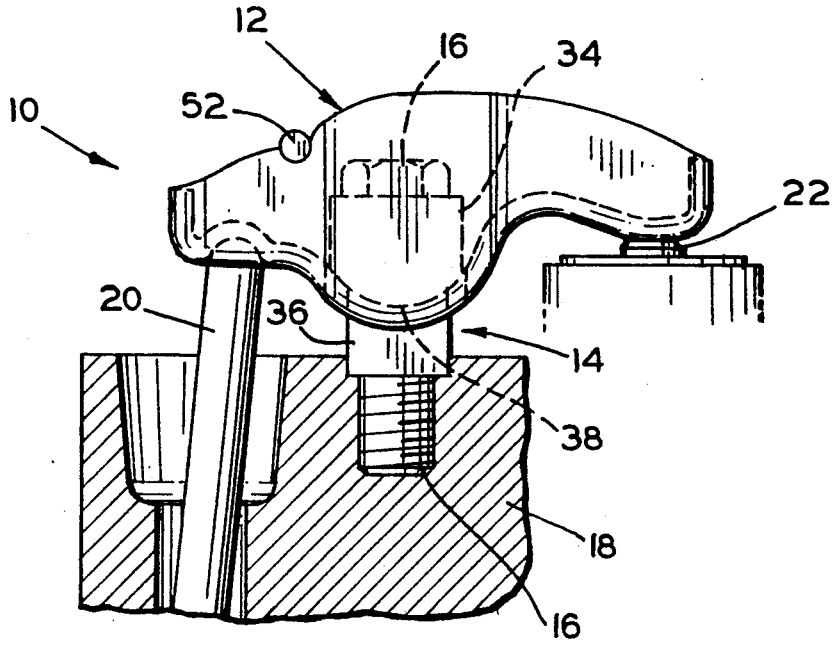
FIG. 1 is a somewhat schematic view in elevation of a rocker arm assembly in accordance with the invention, mounted on an engine block shown in cross section.

Referring particularly to FIG. 1, a rocker arm assembly in accordance with the invention is indicated at 10 and includes a boat-type rocker arm 12 mounted on a pivotal support or pedestal 14. A suitable threaded fastener 16 extends through the pedestal and mounts the assembly on an engine block 18. One end of the rocker arm 12 engages the upper end of a push rod 20 and the other end engages the upper end of a valve stem 22.

Figure 3:
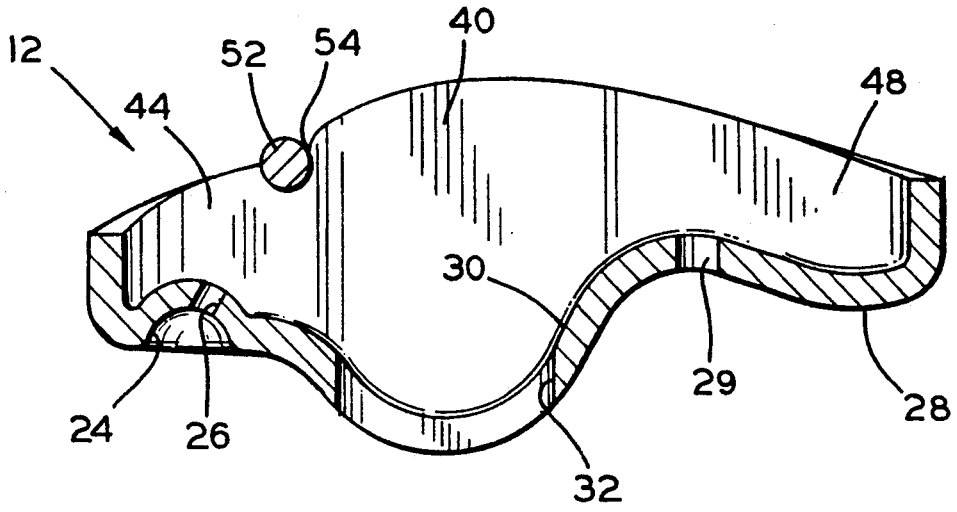
FIG. 3 is a view in longitudinal cross section taken through the rocker arm of FIG. 2.

Referring particularly to FIG. 3, the rocker arm 12 has a concave recess 24 which receives the upper end of the push rod 20, with a lubricating hole 26 communicating with the recess 24 and with the interior of the rocker arm. The other end of the rocker arm 12 has a convex surface or pad 28 which engages the upper end of the valve stem 22. Oil is supplied upwardly through a central passage (not shown) in the push rod 20 and flows through the lubricating hole 26 into the interior of the rocker arm 12. This oil lubricates the pedestal 14 and also flows through a lubricating port 29 toward the push rod end of the rocker arm to supply oil to the pad 28.

Figure 4:
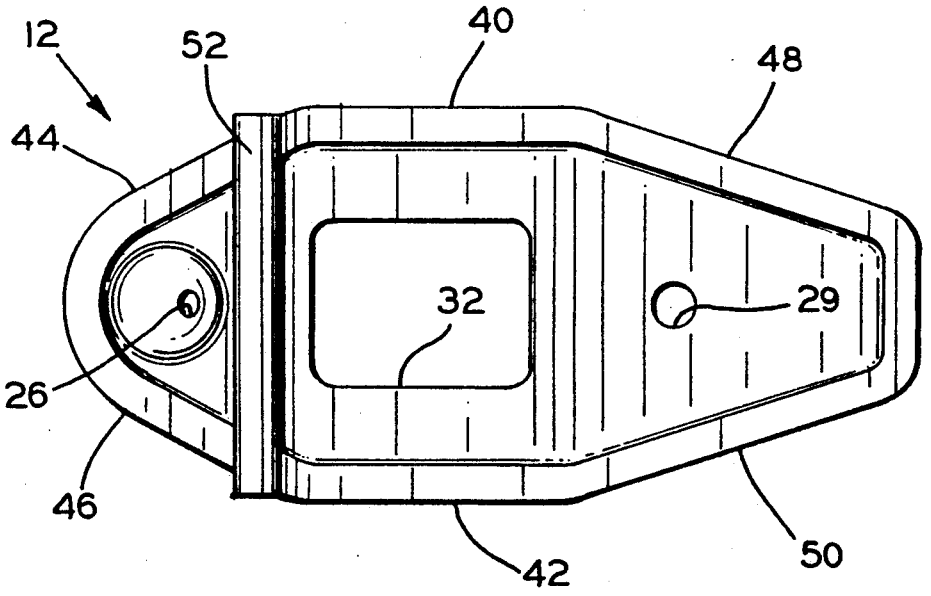
FIG. 4 is a top view of the rocker arm.

An intermediate portion of the rocker arm has a recessed area or surface 30 which is concave and of generally semicylindrical shape. As shown in FIGS. 3 and 4, the recess 30 has a centrally located rectangular opening 32 therein. The pedestal 14 includes a fulcrum or head 34 (FIG. 1) and a shank 36. The fulcrum 34 extends transversely beyond both sides of the shank 36 and has lower, downwardly-extending surfaces 38 which engage the concave surface 30 of the rocker arm 12. Other pedestals, such as those with roller bearings, can also be used.

The rocker arm 12 has substantially parallel side walls 40 and 42 which are structurally integral with the rocker arm bottom, specifically the recessed area 30 thereof, and extend upwardly in generally parallel relationship. The rocker arm also has angular side walls 44 and 46 extending angularly inwardly toward the push rod end of the rocker arm and angular side walls 48 and 50 extending angularly inwardly toward the valve stem end of the rocker arm. Heretofore, the tendency of the rocker arm to buckle or deflect was greatest where the angular side walls 44–50 meet the parallel side walls 40 and 42.

In accordance with the invention, an elongate stiffening member or rod 52 is positioned transversely to the rocker arm body and is affixed to upper edge portions of side walls thereof. Specifically, the stiffening member 52 is affixed to upper edges of the inwardly-extending side walls 44 and 46 near the parallel side walls 40 and 42. This is the position where deflection of the rocker arm during operation is usually the greatest. Also, in this position, the stiffening member does not interfere with the assembly of the supporting pedestal 14 with the rocker arm by being inserted through the opening 32.

Figure 2:
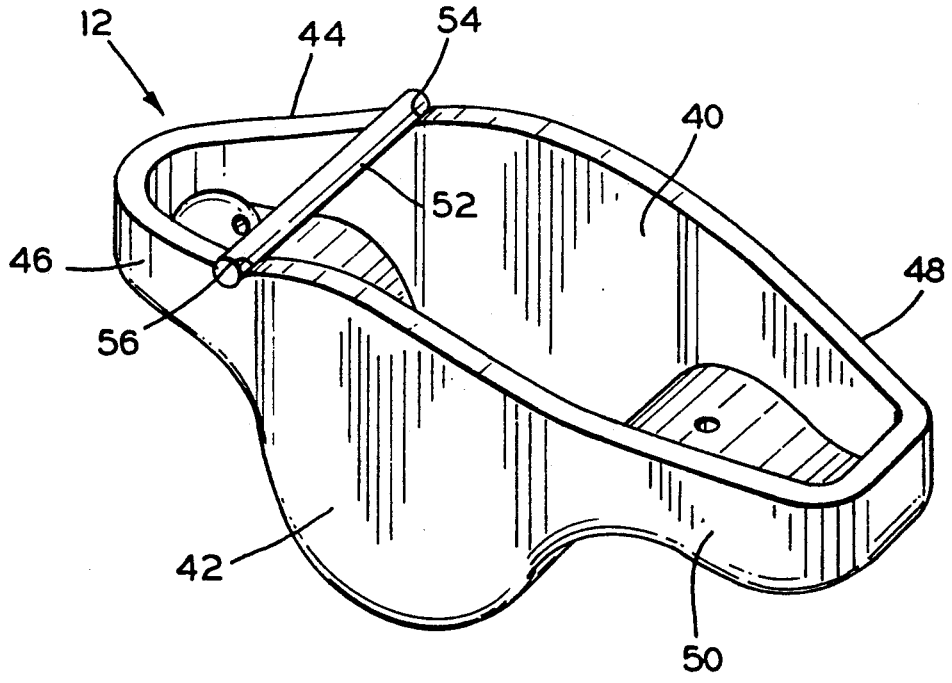
FIG. 2 is an enlarged view in perspective of a rocker arm shown in FIG. 1.

The stiffening member 52 is preferably affixed in notches 54 and 56 (FIGS. 2 and 3) in the upper edges of the side walls 44 and 46. In this manner, the stiffening member 52 does not extend above the profile of the rocker arm 12, as viewed in FIG. 3. The notches 54 and 56 also lower the stiffening member 52 to reduce the moment of inertia. The stiffening member prefereably is affixed by resistance welding.

As shown in FIG. 4, the stiffening member 52 does not extending beyond the plane of the side walls 40 and 42 so as not to interfere with other components which may be adjacent the rocker arm 12. Consequently, the stiffening member can be used with any rocker arm where the arm can operate without the stiffening provisions.

In actual tests, it has been found that the use of the stiffening member 52 with the rocker arm 12 increased stiffness thirty-six to thirty-seven percent.

Stiffening rods 52 have been employed between the upper edges of the inwardly-extending side walls 48 and 50 near the parallel side walls 40 and 42. These have been found not to be as effective. Further, stiffening rods at both positions have been employed but the additional rod has had limited stiffening effect.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. A rocker arm comprising an elongate, one-piece metal body having a push rod engaging end and a valve stem engaging end, said body having two generally parallel side walls and a connecting bottom wall therebetween, said body having angular side walls extending inwardly toward both ends of said body from said parallel side walls, said rocker arm body having means for receiving a pivotal support, and an elongate stiffening member affixed to upper edges of said angular side walls extending toward said push rod end, said elongate stiffening member being positioned above said bottom wall in a vertical plane between said push rod end and said receiving means, when said body is in a horizontal position.

2. A rocker arm according to claim 1 wherein said stiffening member is a rod.

3. A rocker arm according to claim 1 wherein said stiffening member is affixed by welds.

4. A rocker arm according to claim 1 wherein said stiffening member is received in notches in said upper edges.

5. A rocker arm according to claim 1 wherein the ends of said stiffening member do not extend beyond the planes of said parallel side walls.

6. A rocker arm comprising an elongate, one-piece metal body having side walls which are parallel at intermediate portions and extend inwardly towards both ends of said body beyond said parallel portions, said body having a connecting bottom wall extending between said side walls, said bottom wall having means for receiving a pivotal support, means for engaging a push rod, and means for engaging an end of a valve stem, and a stiffening member extending transversely of said elongate rocker arm body above said bottom wall and affixed to upper edges of said side walls.

7. A rocker arm according to claim 6 wherein said stiffening member lies in a vertical plane between said push rod engaging means and said means for receiving the pivotal support, when the rocker arm body is in a horizontal position.

8. A rocker arm according to claim 6 wherein said stiffening member is a rod.

9. A rocker arm according to claim 6 wherein said stiffening member is affixed by welds.

10. A rocker arm according to claim 6 wherein said stiffening member is received in notches in said upper edges.

11. A rocker arm according to claim 6 wherein the ends of said stiffening member do not extend beyond the planes of said parallel side walls.

12. A rocker arm comprising an elongate body having a push rod engaging end and a valve stem engaging end, said body having a bottom wall and two generally parallel side walls, said body having angular side walls extending inwardly toward the push rod engaging end of said body from said parallel side walls, said rocker arm body having means for receiving a pivotal support, and an elongate stiffening member extending transversely of said elongate rocker arm body above said bottom wall and affixed to upper edges of said angular side walls near said generally parallel side walls.

13. A rocker arm according to claim 12 wherein said stiffening member is a rod.

14. A rocker arm according to claim 12 wherein said stiffening member is affixed by welds.

15. A rocker arm according to claim 12 wherein said stiffening member is received in notches in said upper edges.

16. A rocker arm according to claim 12 wherein the ends of said stiffening member do not extend beyond the planes of said parallel side walls.

17. A rocker arm according to claim 12 wherein said bottom wall has a recess for receiving an end of the push rod, said bottom wall having a lubricating hole communicating with said recess, and said bottom wall having a lubricating port extending therethrough near the valve stem engaging end of said body.

* * * * *